United States Patent [19]

Hank et al.

[11] Patent Number: 5,024,156

[45] Date of Patent: Jun. 18, 1991

[54] SAFETY DEVICE FOR THE CONTROL OF WEB-FED ROTARY PRINTING MACHINES

[75] Inventors: Dietrich Hank, Leipzig; Jürgen Gottlebe, Karl-Marx-Stadt, both of German Democratic Rep.

[73] Assignee: Veb Kombinat Polygraph "Werner Lamberz" Leipzig, Leipzig, Fed. Rep. of Germany

[21] Appl. No.: 915,312

[22] Filed: Oct. 3, 1986

[30] Foreign Application Priority Data

Dec. 13, 1985 [DD] German Democratic Rep. ... 284283

[51] Int. Cl.[5] ..... B41F 5/00

[52] U.S. Cl. ..... 101/216; 101/219; 101/228; 250/548; 226/45

[58] Field of Search ..... 101/216, 219, 225, 228; 226/7, 10–11, 14, 33, 39, 34, 44, 45, 97, 195; 250/578, 202, 548; 83/63, 64

[56] References Cited

U.S. PATENT DOCUMENTS

| | | | |
|---|---|---|---|
| 2,840,371 | 6/1958 | Frommer | 250/548 |
| 2,840,372 | 6/1958 | Alhand | 250/548 X |
| 2,873,117 | 2/1959 | Crosfield et al. | 250/548 |
| 3,032,245 | 5/1962 | George | 226/39 |
| 3,071,300 | 1/1963 | Justus | 226/45 X |
| 3,189,295 | 6/1965 | Haley | 226/45 |
| 3,905,533 | 9/1975 | Corse | 101/228 |
| 4,004,510 | 1/1977 | Ruch | 101/228 |
| 4,078,487 | 3/1978 | McComb | 101/228 |
| 4,350,275 | 9/1982 | Kunn | 226/14 |
| 4,411,393 | 10/1983 | Jodrey et al. | 226/45 |
| 4,549,485 | 10/1985 | Nawrath | 101/228 |
| 4,722,275 | 2/1988 | Taguchi et al. | 101/228 |
| 4,728,800 | 3/1988 | Surka | 250/248 |

FOREIGN PATENT DOCUMENTS

| | | | |
|---|---|---|---|
| 148890 | 11/1952 | Australia | 226/45 |
| 2211598 | 9/1973 | Fed. Rep. of Germany . | |
| 2630209 | 7/1976 | Fed. Rep. of Germany | 226/45 |
| 2906037 | 6/1985 | Fed. Rep. of Germany . | |

OTHER PUBLICATIONS

"Management of Dynamic Tension in a Moving Foil Web" IBM Tech. Discl. Bulletin, vol. 15, No. 2, 7/72, p. 513.

"Document Sensor" IBM Tech. Discl. Bulletin, vol. 9, No. 7, 12/66, p. 844.

*Primary Examiner*—Eugene H. Eickholt

*Attorney, Agent, or Firm*—Michael J. Striker

[57] ABSTRACT

A safety device for control of a roller rotary printing machine includes a plurality of sensors positioned either before or behind a web advancing device for recognizing tears or other damages in a region of the edges of the advancing web, an evaluation device having an input connected to the sensors and an output at which an impulse-like control signal is issued, and a switching device connected to the output of the evaluation device and arranged in a path of the web of the printing machine. The switching device is adapted for an abrupt lowering of a web tension upon receiving the signal from the evaluation device.

9 Claims, 2 Drawing Sheets

SAFETY DEVICE FOR THE CONTROL OF WEB-FED ROTARY PRINTING MACHINES

BACKGROUND OF THE INVENTION

The present invention relates to a safety device for the control of a web-fed rotary printing machine.

It has been known that tears or cracks in the paper web in the rotary printing machine, unless detected by fast acting devices for preventing damage to the machine, may become considerably expensive. Stopping and restarting of the machine due to the occurrence of such tears or cracks are also costly.

A device for avoiding web cracks, by controlling web tension in the roller rotary printing machines, has been disclosed in DE-PS 22 11 598. In this conventional device it has been recognized that the web tearing in the majority of cases is signalled by a change of the web tension whose frequency increases with the amplitude increase. The scanning of this web tension change, its indication and utilization for the control of the machine speed or web tension can prevent damage to the machine. This structure has the effect on the dynamic behavior of the paper web which tends to swing.

The disadvantage of this known device resides in that the web tears or cracks are not prevented when such tears or cracks occur in the regions of the edges of the web or in the regions of the glue connected web portions, specifically if the web is under relatively high quasistatic loading. A further disadvantage of the known device is that tears caused by the one-side pulling loads are not prevented either.

A device for preventing tears or cracks or similar damages to the advancing web has been disclosed in DE-PS 26 06 037. In this known device a mechanical scanning device has been provided, which includes a resilient key finger and means which alternate the key finger by penetrating into the crack or hole in the web and are connected to a known control means so that upon the occurrence of a tear or crack a control of the machine is possible.

The disadvantage of the above described device resides in that for contemporary roller rotary printing machines higher web speeds cause increasing inertia of the mechanically operated scanner which is susceptible to trouble and is very expensive for specific technical solutions.

SUMMARY OF THE INVENTION

It is an object of the present invention to provide an improved safety device for the control of a web-fed rotary printing machine.

It is another object of this invention to provide a safety device, by means of which a standstill time and renew start time, of the printing machine due to the occurrence of tears or cracks in the advancing paper web would be substantially reduced.

Yet another object of the invention is to provide a safety device which would prevent tears and cracks due to suddenly occurring web portions with an increased resistance to tears and cracks.

These and other objects of the invention are attained by a safety device for a control of a web-fed rotary printing machine, comprising sensors positioned at least before and behind a web advancing device and operative for recognizing tears or other damages in a region of edges of the advancing web; an evaluation device having an input connected to said sensors and an output, at which an impulse-like control signal Ust indicative of recognizing a tear in said web by said sensors is issued; and switching means connected to said output of said evaluation device and arranged in a path of said web of the printing machine and operative for an abrupt lowering of a web tension upon receiving said signal.

Said sensors may be adjustably arranged transversely of the direction of advancing the paper web so as to obtain various loading values relative to the length of the tear with the roller webs of various resistance to tearing.

When a tear or crack occurs in the advancing web in the regions of the edges of the web an impulse signal is issued at the output of the evaluation device. This control signal is fed into the switching means for an abrupt lowering of the web tension. After the web tension has been reduced the danger of tearing the web is prevented.

The evaluation device may have a further output at which a warning and control signal is issued, said signal starting timely upon the recognition of the tear at said region of the advancing web and ending when a time interval of a machine cycle has expired after a last recognition of a tear or other damages to the web at said region; the device further including an indication element for indicating danger of a web tear occurrence, said indication element being positioned at a central remote control station of the printing machine and being connected to said further output, a first switch element for lowering a speed of the advancing web, and a second switch element for removing waste paper, said first and second switch being connected to said further output. The advantage of such an embodiment resides in that the indication of the danger of web tearing following by the reduction of the web speed and removal of waste paper take place so that a dangerous situation can be ended.

Each sensor may be formed as an optoelectronic reflection or a fork coupler.

An outlet nozzle opening issuing a blow air stream, may be arranged in an optical path of said coupler whereby due to a direction and intensity of the blow air stream the recognition of a tear or other damage in the web is supported.

According to another embodiment, a web guiding means for deflecting a web path may be arranged in an optical path of said coupler whereby due to a direction and a radius of deflection of said web path the recognition of a tear or other damage in the web is supported.

The advantage of these embodiments resides in that a contactless digital electronics with its advantages such as reliability, simplicity and safety can be utilized in a process regulation of the printing machine.

Each sensor may include a feeler for measuring a partial web tension in said region whereby a signal indicative of the partial web tension is compared in said evaluation device with a middle value of the web tension and when said partial web tension measured exceeds or falls below said middle value by at least a predetermined value said impulse-like control signal Ust is issued at the output of the evaluation device.

When a non-permissible one-side pulling load on the web occurs, and the partial web tension exceeds the middle value by at least a predetermined value, in this case a pulse signal will be also issued at the output of the evaluation device. Thereby the device will react to suddenly occurring tears and to suddenly one-side pulling loads.

According to a further embodiment of the invention an opto-electronic sensor for recognizing glue connections in said web may be connected to a further input of said evaluation device and is arranged before or immediately behind said web advancing device whereby at said output of said evaluation device said control signal Ust is issued upon the recognition of a glue connection in the advancing web.

In a further modification of the invention the switching means for lowering web tension may include a guide roller for guiding said web, a pivotable lever for supporting said guide roller, a tensioning mechanism operatively connected to said roller via said lower the same in an upper end position, said mechanism having a safety catch and an electromagnet for releasing said safety catch, said roller being pivotable in a downward direction of a web path when said catch is released, an adjustment drive operatively connected to said tensioning mechanism and continuously operated with an adjustment speed proportional to a machine speed and pivoting said roller back to the upper end position, and a machine cycle-controlled timing element which switches said adjustment drive on when a non-operative time proportional to a machine cycle time has expired and switches said adjustment drive off when a switching time proportional to a machine cycle time has expired.

The advantage of the switching device resides in that the abrupt reduction of the web tension is connected with an impact-free and progressive restoring without the danger of stretching the web.

The invention therefore abandons the usual compensating roller loaded by the pneumatic thrust piston controllable by a pneumatically releasable evaluation device.

The blocking voltage mechanism may be a stepping locking mechanism. Thereby the safety device can react to the occurrence of a tear in the web before a dangerous situation can take place.

Finally, it should be noted that the safety device of this invention includes inexpensive structural components and provides for a substantially reduced chance of a web crack or tear risk.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
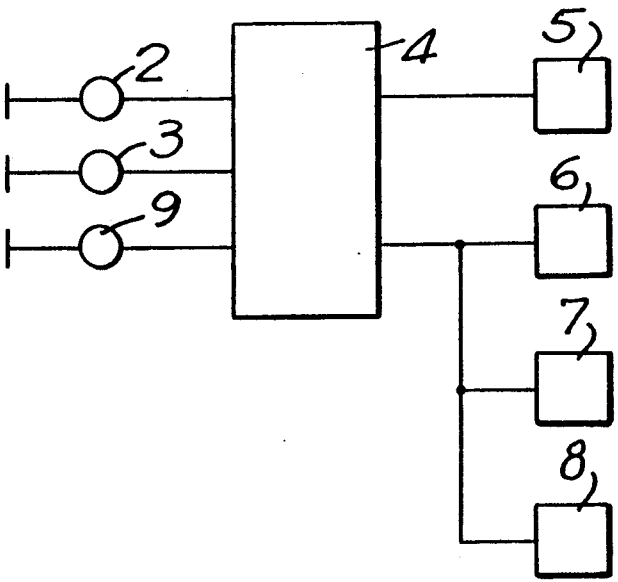
FIG. 1 is a flow chart diagram of the safety device according to the invention.
Figure 2:
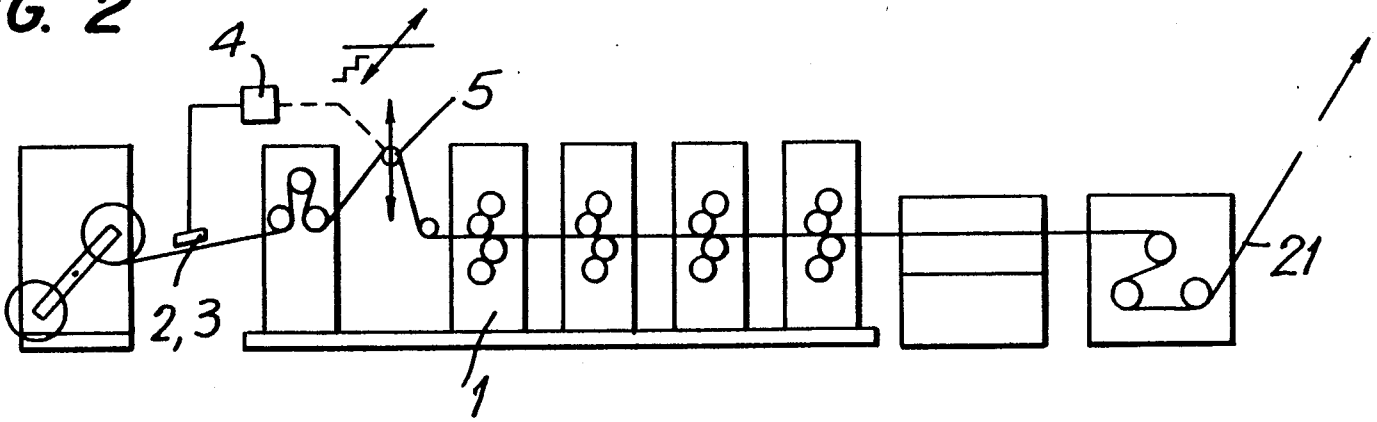
FIG. 2 is a schematic view of a web-fed rotary printing machine with the safety device of the invention.
Figure 3:
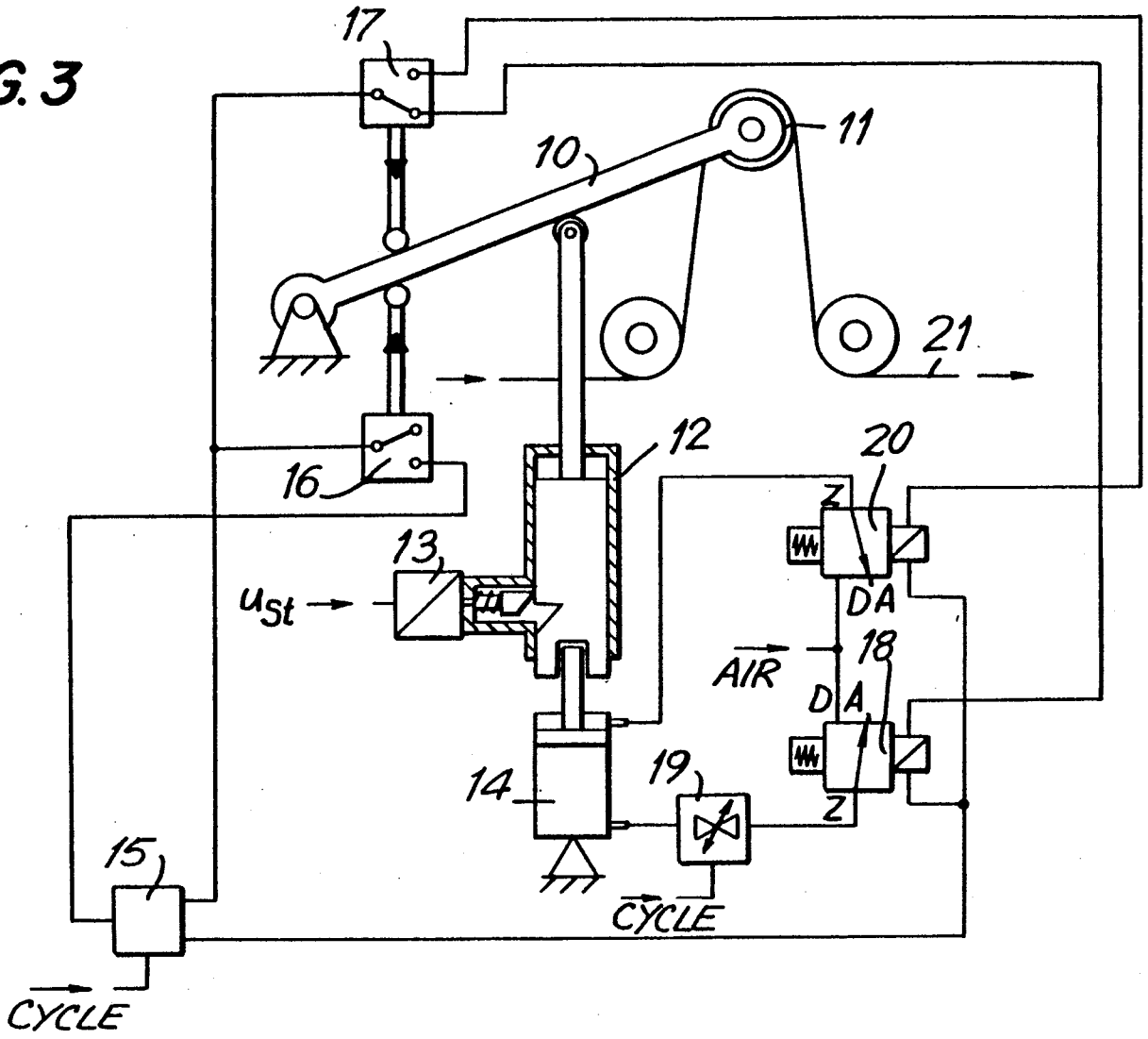
FIG. 3 is a schematic view of a switch device for abrupt lowering of a web tension.

Referring now to the drawings in detail, and firstly to FIGS. 1 and 2 thereof, it will be seen that sensors 2 and 3 for determining cracks or other damages in a paper web 21 are arranged before a web advancing device 1, each sensor being formed as an optoelectronic forked coupler and positioned in the region of the web edges. Sensors 2, 3 are connected to the input of an evaluation device 4. Outlet nozzle openings are also arranged respectively on an optical path of each fork coupler.

The first output of the evaluation device 4 is connected to a switch device or element 5 for abrupt lowering of web tension, which switch device is positioned in the path of advancement of the web in the printing machine. The second output of the evaluation device 4 is connected to an optically or acoustically operating indicating element 6 for indicating danger of the occurrence of a crack on the web at a central remote control station of the printing machine. The second output of evaluation device is further connected to a switch element 7 for lowering the speed of the advancing web and to a switch element 8 for separating or eliminating waste paper.

The switch element 15 for abrupt lowering of the web tension is a guide roller 11 arranged in the path of the web of the printing machine and positioned in pivotable lever 10. By a tensioning mechanism 12 with a one-step safety catch the guide roller 11 is held in an upper end position. The safety catch of the mechanism 12 is releasable by an electromagnet 13 which is connected to the first output of the evaluation device 4. When the safety catch is released the guide roller 11 is pivoted to its lower end position.

The guide roller 11 is swingable back to its upper end position by means of an adjustment drive 14 which can be a pneumatic thrust piston drive. The adjustment drive 14 is switchable by a machine cycle-controlled timing element 15 in the input circuit of which an operation contact of an end switch 16 for a lower end position is located and in the output circuit of which an inoperative contact of an end switch 17 for the upper end position is located. Also connected in series with the end switch 17 is a magnetic coil of a check valve 18 positioned in a pressure conduit for the upward movement of the thrust piston. Further connected in series with the check valve 18 and in the same pressure conduit is a machine cycle-controlled throttle valve 19.

In the output circuit of the machine cycle-controlled timing element 15, is positioned a magnetic coil of a check valve 20, connected to an operative contact of the end switch 17 for the upper end position. Check valve 20 is positioned in the pressure conduit and is operated for the downward movement of the thrust piston in the adjustment drive 14.

When a crack in the region of the edges of the web occurs the crack of paper web 21 will be recognized by sensor 2 or 3 with a blow air-supported, optoelectronic fork coupler, arranged at the edge area of the advancing web. At the first output of the evaluation device 4, an impulse-shaped control signal Ust will be issued. The safety catch of the tensioning mechanism 12 is then released in an impulse fashion, and under the influence of its own weight and web tension the guide roller 11 will pivot to its lower position and the web will be abruptly released.

At the same time, a warning and control signal, which starts upon the recognition of the crack, is issued at the second output of the evaluation device 4, this signal ends after the recognition of the crack in the web before the time period of the machine cycle has expired. The indication element 6 for indicating danger of the crack occurrence at the central remote control station of the printing machines issues an optical or acoustic alarm signal for ending a dangerous situation.

Furthermore, the switch element 7 for lowering the web speed and the switch element 8 for separating waste paper are switched on for ending the dangerous situation. As soon as the guide roller 11 is in its lower end position the machine cycle-controlled timing element 15 is actuated by the end switch 16 for the lower end position. After the inoperative time, which is proportional to the time of the machine cycle, has expired the timing element 15 switches on the adjustment drive 14, and the check valve 18 for the upward movement of the thrust piston in the adjustment drive 14 opens.

With the adjustment speed which by means of the machine cycle-controlled throttle valve 19 is set proportional to the machine speed, the guide roller 11 pivots back and, upon reaching its upper end position, is stopped by the safety catch in the tensioning mechanism 12.

The normally open inoperative contact of the end switch 17 for the upper end position closes the check valve 18 for the upward movement of the thrust piston whereas the normally closed operative contact of the end switch 17 opens the check valve 20, for the downward movement of the thrust piston in the adjustment drive 14; the thrust piston is guided back to the lower end position. After the switching time, which is proportional to the machine cycle time, has expired the timing element 15 switches off the adjustment drive 14, and the check valve 20 for the downward movement of the thrust piston of the adjustment drive 14 closes.

It will be understood that each of the elements described above, or two or more together, may also find a useful application in other types of safety devices for the control of rotary printing machines, differing from the types described above.

While the invention has been illustrated and described as embodied in a safety device for the control of a rotary printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A safety device for a control of a web-fed rotary printing machine including a printing means, a device for advancing a web having a predetermined tension past the printing means, drive means for driving the web advancing device to advance the web at a predetermined speed, waste paper removing means, and a central control station for controlling the printing press, said safety device comprising sensors positioned at least before and behind the web advancing device and operative for recognizing tears in a region of edges of the advancing web; an evaluation device having an input connected to said sensors and an output, at which an impulse-like control signal Ust, indicative of recognizing a tear in said web by said sensors, is issued; switching means connected to said output of said evaluation device and arranged in a path of said web of the printing machine and operative for an abrupt lowering of the web tension upon receiving said signal; said evaluation device having a further output at which a warning and control signal is issued, said signal starting timely upon the recognition of the tear at said region of the advancing web and ending when a time interval of a machine cycle of the printing machine has expired after a last recognition of a tear to the web at said region; an indication element for indicating danger of a web tear occurrence, said indication element being positioned at a central remote control station of the printing machine and being connected to said further output, a first switch element for lowering a speed of the drive means to thereby lower a speed of the advancing web and a second switch element for actuating the waste removing means, said first and second switch elements being connected to said further output.

2. A safety device for a control of a web-fed rotary printing machine including printing means and a device for advancing a web past the printing means with a predetermined tension, said safety device comprising sensors positioned at least before and behind the web advancing device and operative for recognizing tears in a region of edges of the advancing web; an evaluation device having an input connected to said sensors and an output, at which an impulse-like control signal Ust, indicative of recognizing a tear in said web by said sensors, is issued; switching means connected to said output of said evaluation device and arranged in a path of said web of the printing machine and operative for an abrupt lowering of the web tension upon receiving said signal; each of said sensors being formed as an optoelectric coupler; and an outlet nozzle opening issuing a blown air stream, being arranged in an optical path of said coupler, whereby due to a direction and intensity of the blown air stream the recognition of a tear in the web is assisted.

3. Device as claimed in claim 2, wherein said coupler is a reflection coupler.

4. Device as defined in claim 2, wherein said coupler is a fork coupler.

5. A safety device for a control of a web-fed rotary printing machine including printing means and a device for advancing a web past the printing means with a predetermined tension, comprising sensors positioned at least before and behind the web advancing device and operative for recognizing tears in a region of edges of the advancing web; and evaluation device having an input connected to said sensors and an output, at which an impulse-like control signal Ust, indicative of recognizing a tear in said web by said sensors, is issued; switching means connected to said output of said evaluation device and arranged in a path of said web of the printing machine and operative for an abrupt lowering of the web tension upon receiving said signal; each of said sensors being formed as an optoelectric coupler; and a web guiding means for deflecting a web path being arranged in an optical path of said coupler whereby due to a direction and radius of deflection of said web path the recognition of a tear in the web is assisted.

6. Device as defined in claim 5 wherein said coupler is a reflective coupler.

7. Device as defined in claim 5 wherein said coupler is a fork coupler.

8. A safety device for a control of a web-fed rotary printing machine including printing means and a device for advancing a web past the printing means with a predetermined tension, comprising sensors positioned at least before and behind the web advancing device and operative for recognizing tears in a region of edges of the advancing web; an evaluation device having an input connected to said sensors and an output, at which an impulse-like control signal Ust, indicative of recognizing a tear in said web by said sensors, is issued; switching means connected to said output of said evaluation device and arranged in a path of said web of the printing machine and operative for an abrupt lowering of the web tension upon receiving said signal; each of said sensors being formed as an optoelectric coupler; said switching means including a guide roller for guiding said web, a pivotable lever for supporting said guide roller, a tensioning mechanism operatively connected to said lever to hold said roller in an upper end position, said mechanism having a safety catch and an electromagnet for releasing said safety catch, said lever being pivotable in a downward direction of a web path when said catch is released, an adjustment drive operatively connected to said tensioning mechanism and continuously operated with an adjustment speed proportional to a printing machine speed and pivoting said lever back to the upper end position of said roller, and a printing machine cycle-controlled timing element which switches said tensioning mechanism on when a non-operative time proportional to a printing machine cycle time has expired and switches said adjustment drive off when a switching time proportional to a printing machine cycle time has expired.

9. Device as defined in claim 8, wherein said tensioning mechanism is a stepping locking mechanism.

* * * * *